US007653955B2

(12) United States Patent
Jo et al.

(10) Patent No.: US 7,653,955 B2
(45) **Date of Patent: *Feb. 2, 2010**

(54) WASHING MACHINE AND METHOD FOR GUIDING USE OF THE SAME

(75) Inventors: Seong-Jin Jo, Changwon-shi (KR); So-Young Cho, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 150 days.

This patent is subject to a terminal disclaimer.

(21) Appl. No.: 10/311,143

(22) PCT Filed: Jun. 12, 2001

(86) PCT No.: PCT/KR01/01003

§ 371 (c)(1),
(2), (4) Date: Dec. 13, 2002

(87) PCT Pub. No.: WO01/96644

PCT Pub. Date: Dec. 20, 2001

(65) Prior Publication Data

US 2003/0168084 A1 Sep. 11, 2003

(51) Int. Cl.
*D06F 33/02* (2006.01)

(52) U.S. Cl. ..... 8/158; 68/3 R; 68/12.02

(58) Field of Classification Search ..... 134/65 R, 134/113, 201, 42, 18, 25.1, 32; 68/12.23, 68/12.27; 8/3 R, 12.01–12.05, 12.23, 12.27
See application file for complete search history.

(56) References Cited

U.S. PATENT DOCUMENTS

| | | | | |
|---|---|---|---|---|
| 4,800,740 | A | 1/1989 | Hüttemann | |
| 4,982,606 | A * | 1/1991 | Adamski et al. | 73/304 C |
| 5,279,134 | A | 1/1994 | Nonogaki et al. | |
| 5,694,793 | A * | 12/1997 | Nishimura et al. | 68/12.27 |
| 6,763,687 | B2 * | 7/2004 | Jo et al. | 68/12.01 |
| 2002/0040505 | A1 * | 4/2002 | Tanaka et al. | 8/158 |
| 2003/0089137 | A1 * | 5/2003 | Jo et al. | 68/12.27 |

FOREIGN PATENT DOCUMENTS

| | | | |
|---|---|---|---|
| EP | 0898003 | | 2/1999 |
| EP | 0976862 | | 2/2000 |
| GB | 2 340 257 | A | 2/2000 |
| JP | 03-295591 | | 12/1991 |
| JP | 5168792 | | 7/1993 |
| JP | 6126075 | | 5/1994 |
| JP | 6126081 | | 5/1994 |
| JP | 08-212393 | | 8/1996 |
| JP | 09-084989 | * | 3/1997 |
| JP | 11-041336 | | 2/1999 |
| JP | 11-259577 | | 9/1999 |
| KR | 1001563990000 | B1 | 7/1998 |
| KR | 10-1998-054372 | | 9/1998 |

* cited by examiner

*Primary Examiner*—Frankie L Stinson
(74) *Attorney, Agent, or Firm*—McKenna Long & Aldridge LLP

(57) ABSTRACT

A washing machine and a method for guiding use of the same are disclosed. The method for guiding use of a washing machine having an LCD includes the steps of displaying at least one or more washing strokes on the LCD if a user selects a washing following menu displayed in the LCD by applying a power source, selecting a desired washing stroke from the displayed washing strokes, and displaying a guide message for processing the selected washing stroke. The method provides the user with convenience for use and processes the exact washing stroke.

10 Claims, 22 Drawing Sheets

(d)

(e)

(f)

(a)

(b)

(c)

(d)

(e)

(f)

(c)

(d)

(e)

(d)

(e)

(f)

(g)

WASHING MACHINE AND METHOD FOR GUIDING USE OF THE SAME

TECHNICAL FIELD

The present invention relates to a washing machine, and more particularly, to a washing machine, and a method for guiding use of the washing machine.

BACKGROUND ART

In general, the washing machine rotates a rotating tub, and a pulsator by a driving force of a motor, for conducting washing, rinsing, and spinning, wherein laundry is washed by using friction between the laundry, the washing water, and the rotating tub occurred as washing water and the laundry introduced in the rotating tub are pulsated. The related art washing machine conducts respective cycles automatically according to numbers of times, periods, and etc., of the washing, rinsing, and spinning, either selected, and set by a user directly, or preset by a manufacturer.

A related art washing machine will be explained, with reference to the attached drawings. FIG. 1 illustrates a block diagram showing a system of a related art washing machine schematically.

Referring to FIG. 1, the related art washing machine is provided with a key application part 1 for selecting a user's desired function, a system microcomputer 2 for controlling cycles of the washing machine according to the functions selected through the key application part 1, a motor 3 for being driven under the control of the system microcomputer 2, miscellaneous load driving parts for driving miscellaneous loads, such as a water supply valve, a drain valve, and the like, in response to control signals from the system microcomputer 2, and a display part 5 for displaying operation states, or error occurrences of the functions selected through the key application part 1 in response to control signals from the system microcomputer 2. The display part 5 has 88 segments, and a plurality of light emitting diodes (LED) for displaying a remained time period of washing.

When a user gives a washing command by pressing the key application part 1 on the foregoing related art washing machine, the microcomputer 2 progresses washing by applying control signals to the motor 3, and miscellaneous load driving parts 4 according to a preset sequence of washing cycles, for driving the motor 3, the water supply valve (not shown), the drain valve (not shown), and the like according to the sequence. Also, the microcomputer 2 provides a control signal for displaying set descriptions selected by the user, and displays operation time periods, and remained washing time periods for the washing, rinsing, and spinning cycles for respective washing courses.

However, the related art washing machine has the following problems.

First, the employment of 88 segments, and the LED in the display part is not adequate for displaying a variety of messages on the display part.

Second, the lack of guidance for setting washing conditions for each washing course is inconvenient, particularly, to beginners.

DISCLOSURE OF INVENTION

Accordingly, the present invention is directed to a washing machine, and a method for guiding use of the washing machine that substantially obviates one or more of the problems due to limitations and disadvantages of the related art.

An object of the present invention is to provide a method for guiding use of a washing machine, in which washing condition setting methods, and setting conditions for respective washing cycles are displayed, for allowing the user to press operation buttons with reference to the display, and conduct required cycles.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the washing machine includes a vertical or horizontal water storage tub for storage of washing water, an inner tub rotatably fitted in the water storage tub, a motor for rotating the inner tub, a display window for displaying a variety of washing cycles, guide messages for guiding conduction of the washing cycles selected by a user, and progress of the washing cycles, and a microcomputer for storage of guided washing menu which permits to guide the user to a variety of washing cycles, or washing courses by means of guide messages displayed on the display window.

In other aspect of the present invention, there is provided a method for guiding use of a washing machine having an LCD, including the steps of (a) displaying at least more than one washing cycles on the LCD if a user applies a power, and selects a guided washing from menu displayed on the LCD, (b) selecting a washing cycle the user desires from the washing cycles displayed on the LCD, and (c) displaying a guide message for progressing the selected washing cycle.

In another aspect of the present invention, there is provided a method for guiding use of a washing machine having a key application part for selecting a user's desired washing course and washing conditions, a storage part for storing a washing machine operation algorithm, washing courses, and a guide message for each washing course, and an LCD for displaying the guide message for the washing course set up through the key application part, and/or operation states of the washing machine, including the steps of (a) displaying progresses of all cycles of washing, rinsing, and spinning, and a progress of one cycle, (b) displaying at least one washing course if the user selects conduction of a cycles, (c) if the user selects a washing course from the displayed washing courses, displaying a condition setting up screen for conduction of washing, rinsing, and spinning according to a selected conduction order of washing courses, and (d) conducting required cycles if the user sets up a desired condition from the condition setting up screen, and applying an operation starting signal.

It is to be understood that both the foregoing general description and the following detailed description are exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Figure 2:
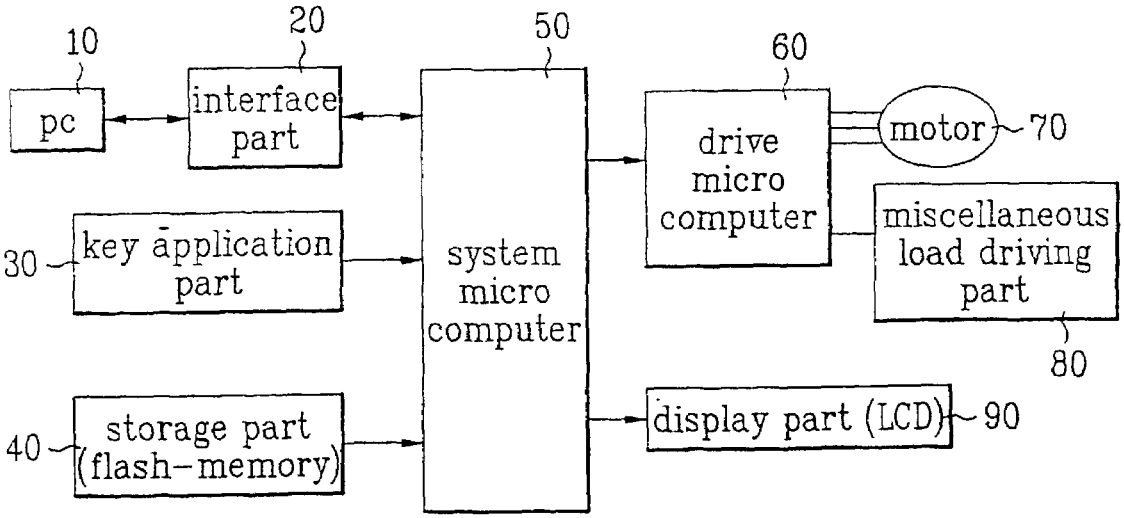
FIG. 2 illustrates a block diagram showing a system of a washing machine in accordance with a preferred embodiment of the present invention.
Figure 3A:
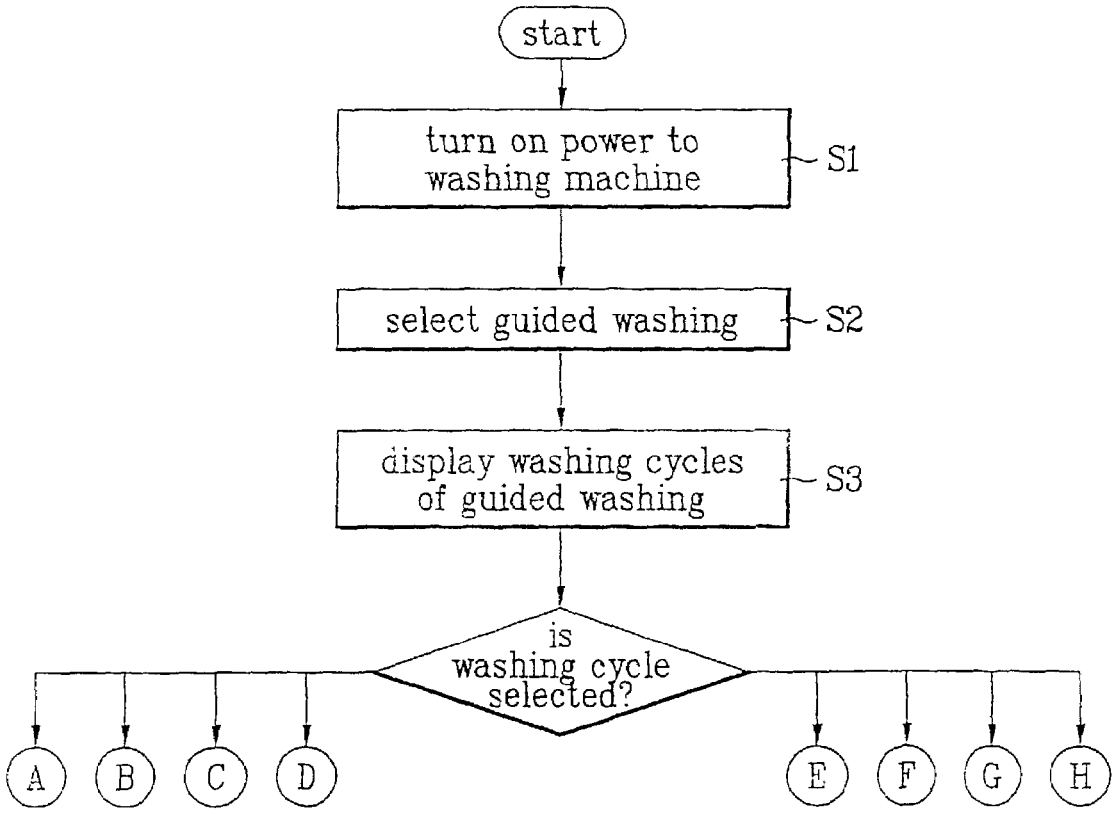
FIGS. 3A–3I illustrate flow charts each showing the steps of a method for guiding use of a washing machine in accordance with a preferred embodiment of the present invention.
Figure 3B:
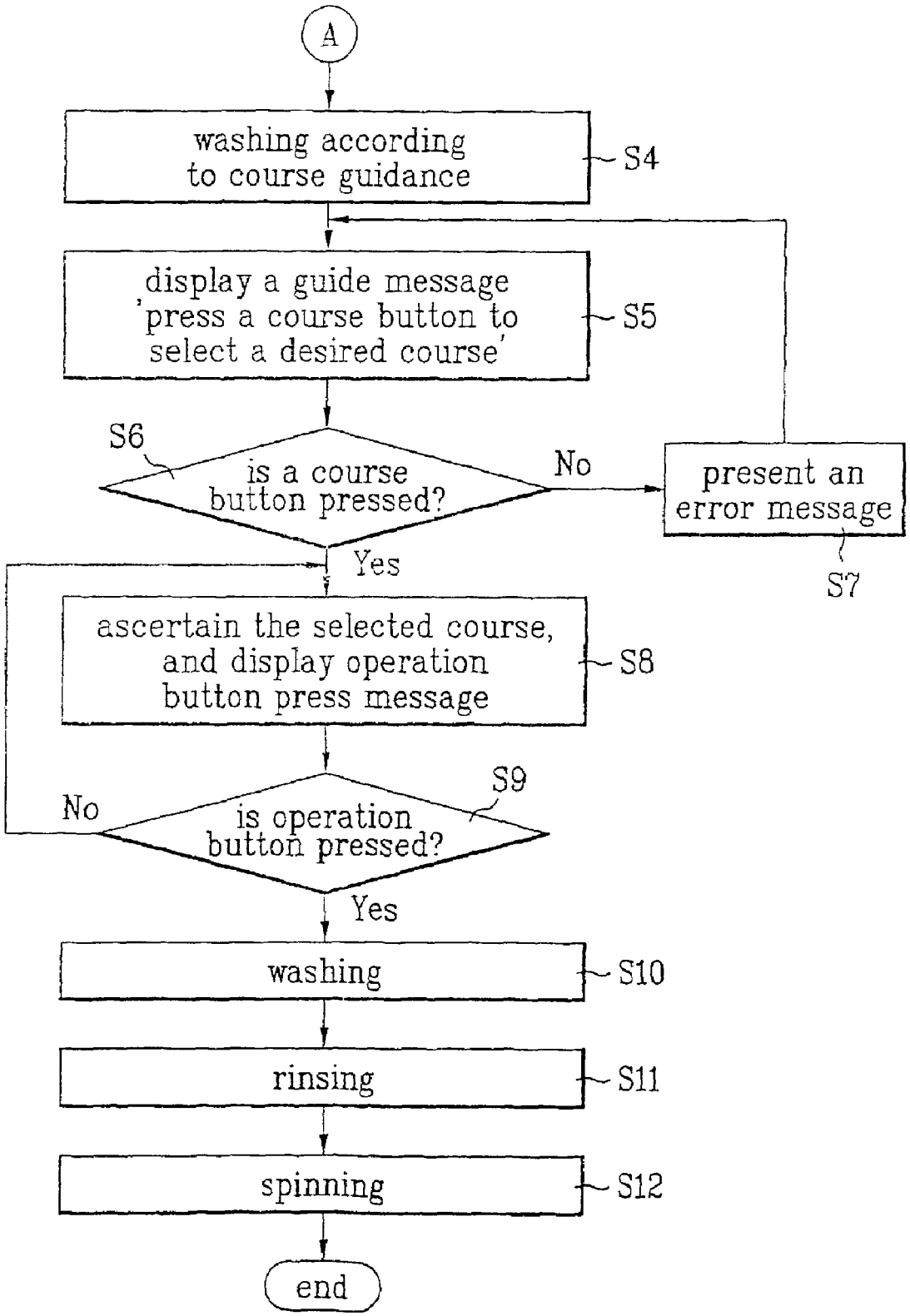
Figure 3C:
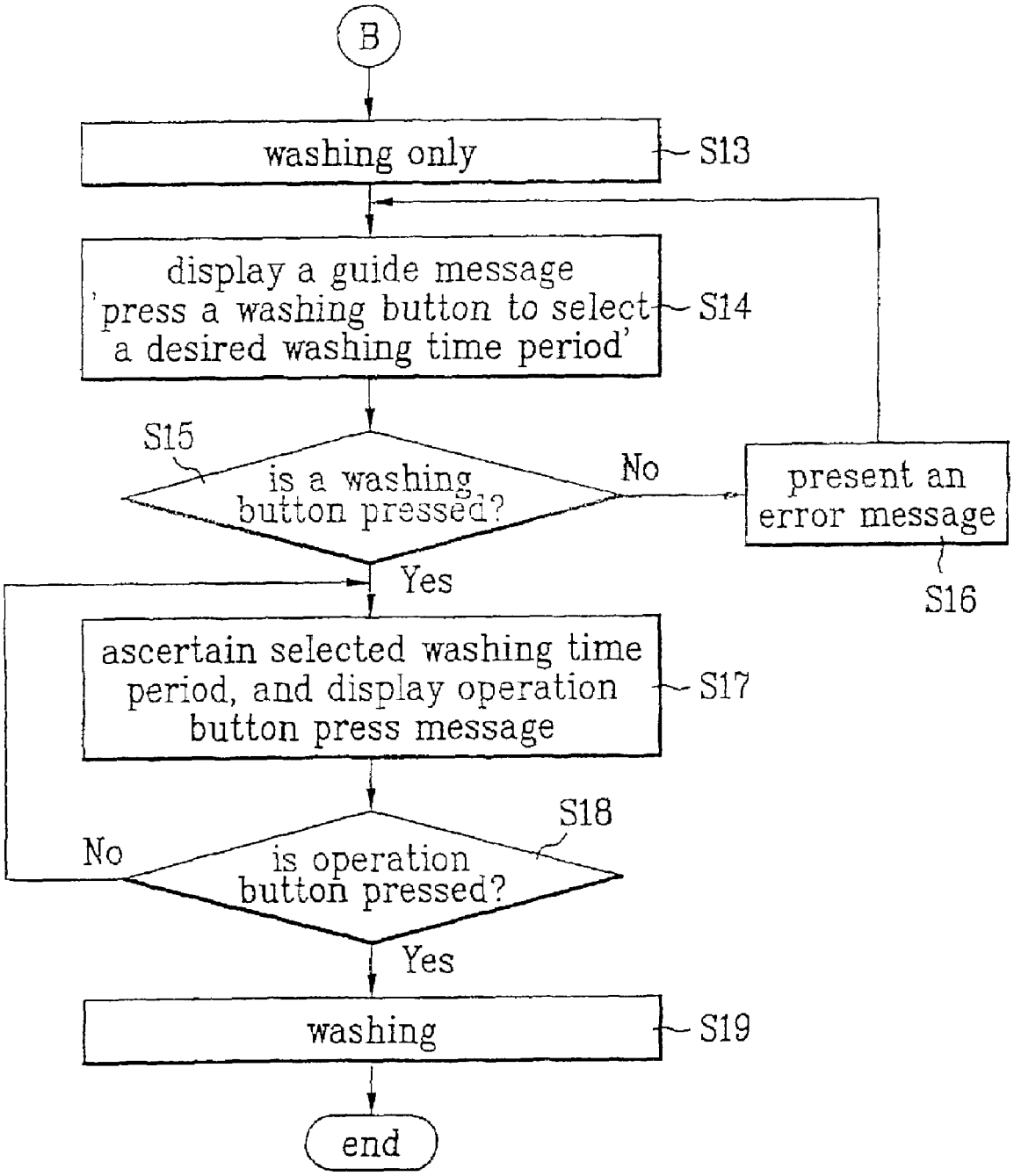
Figure 3D:
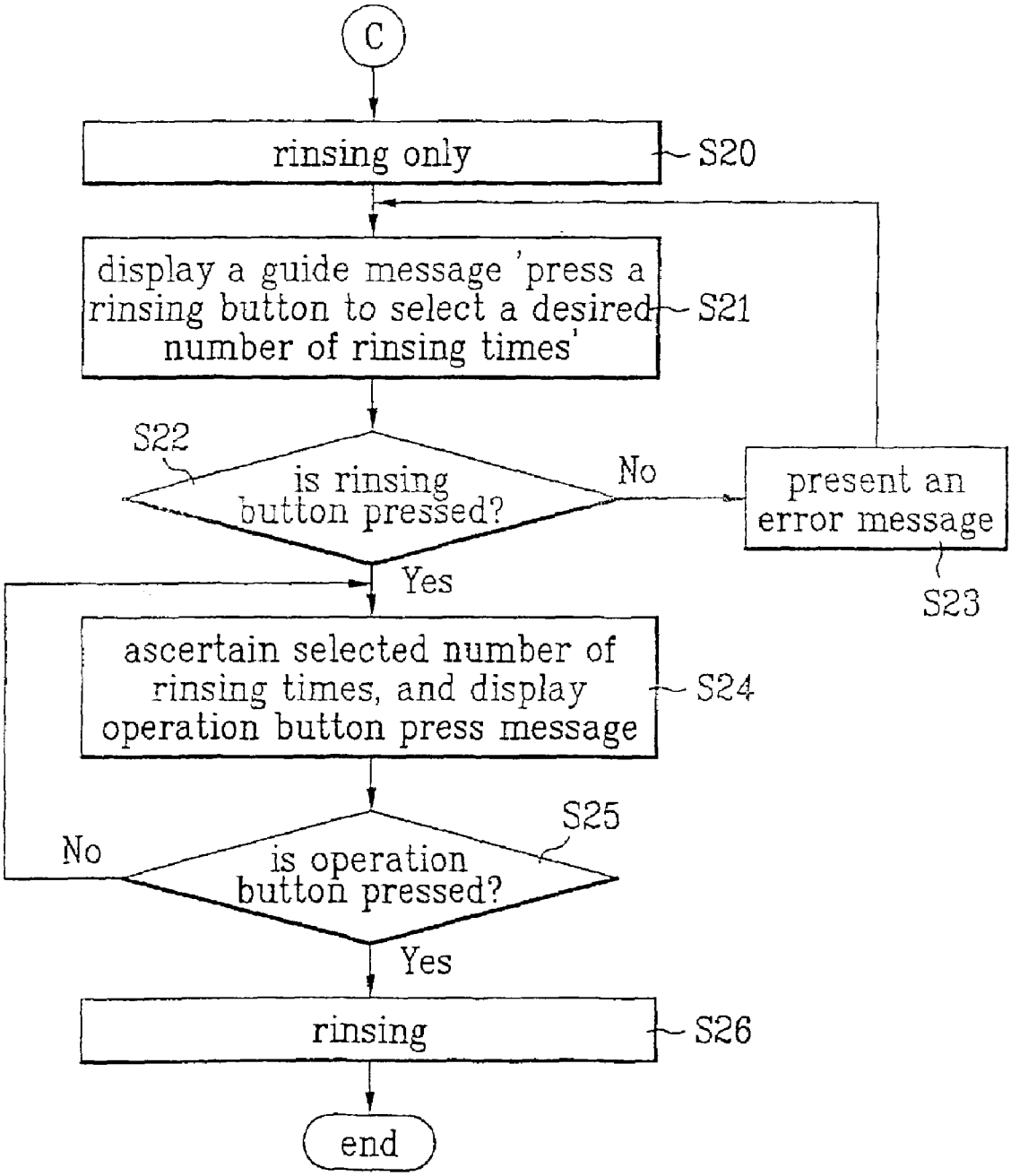
Figure 3E:
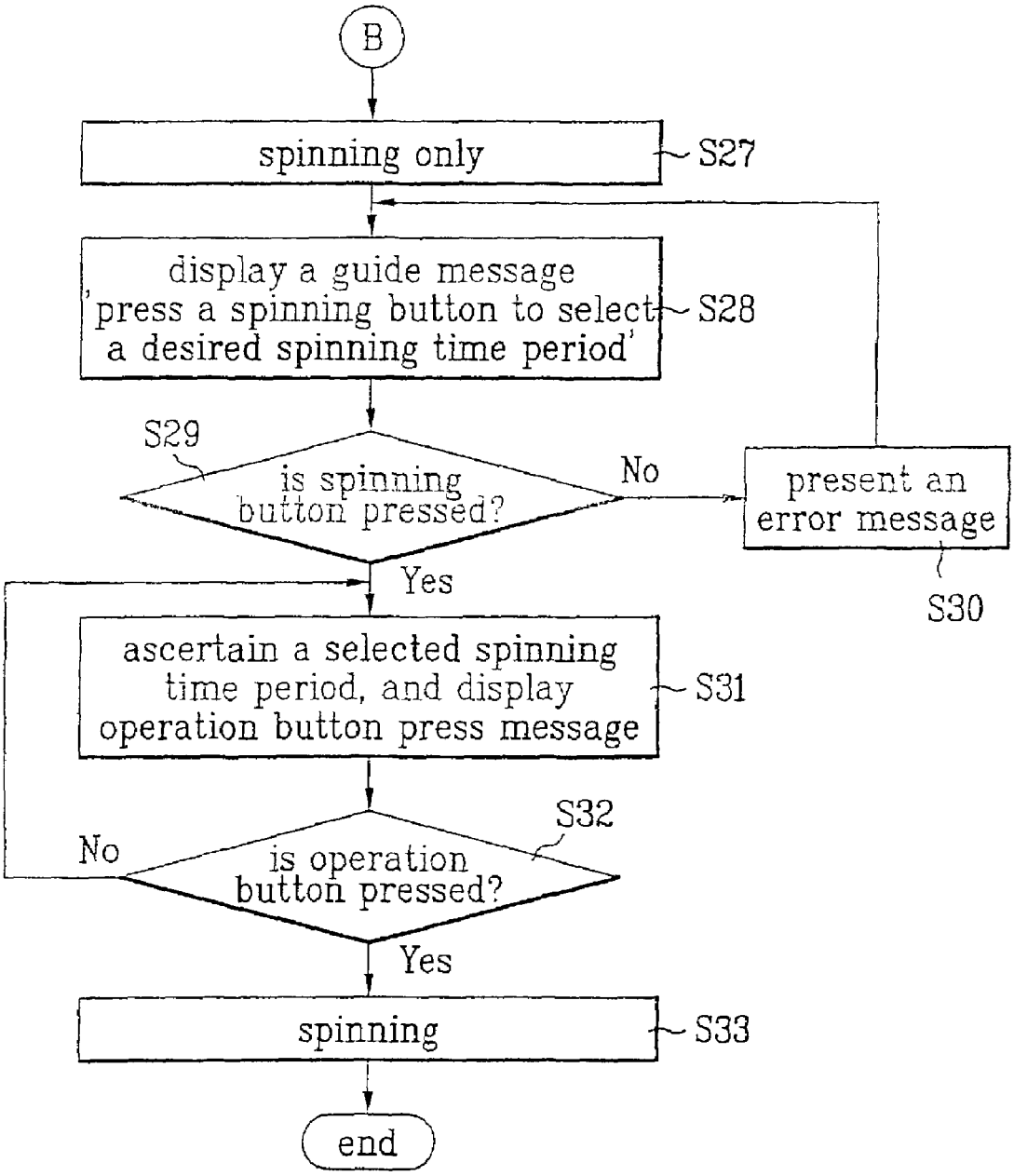
Figure 3F:
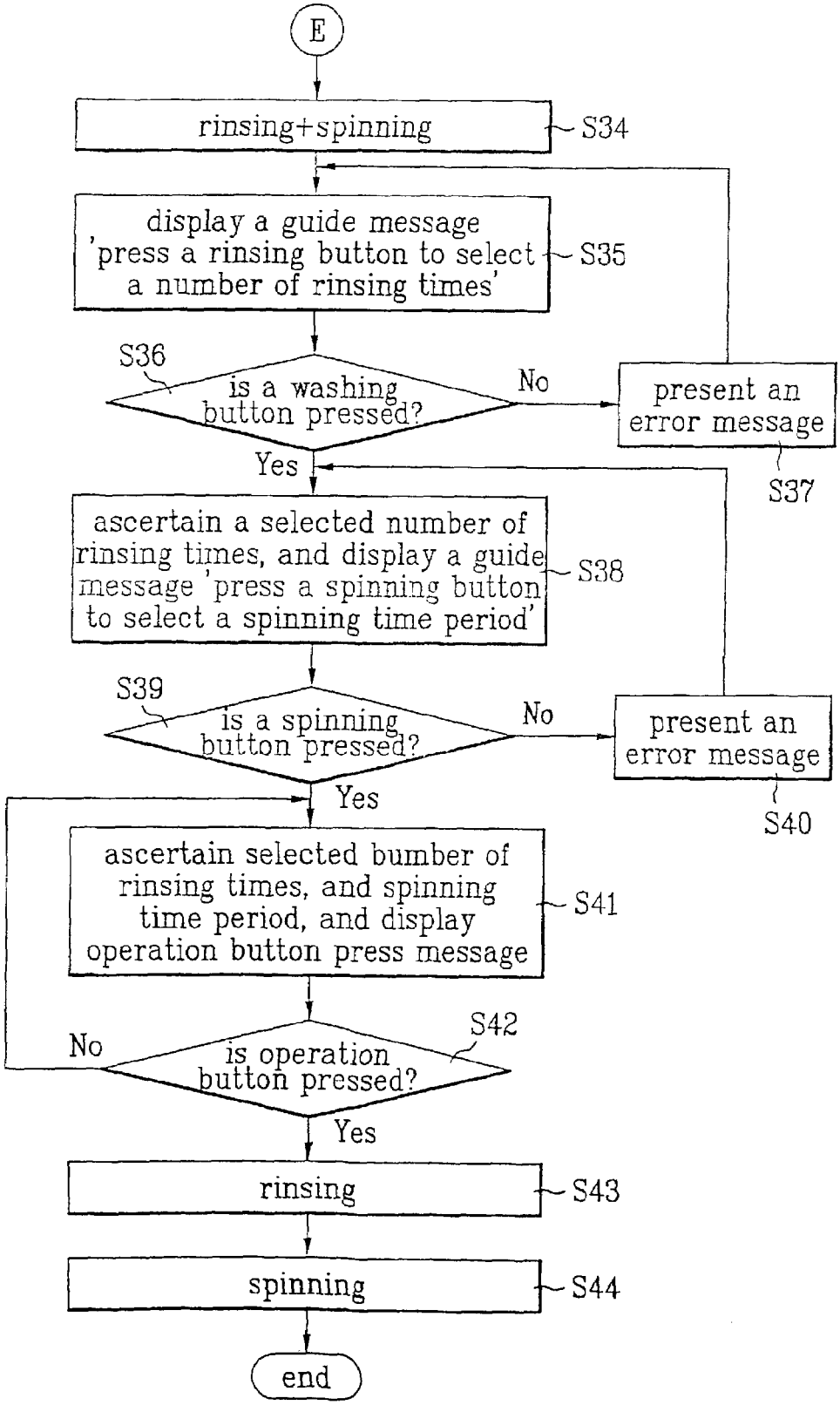
Figure 3G:
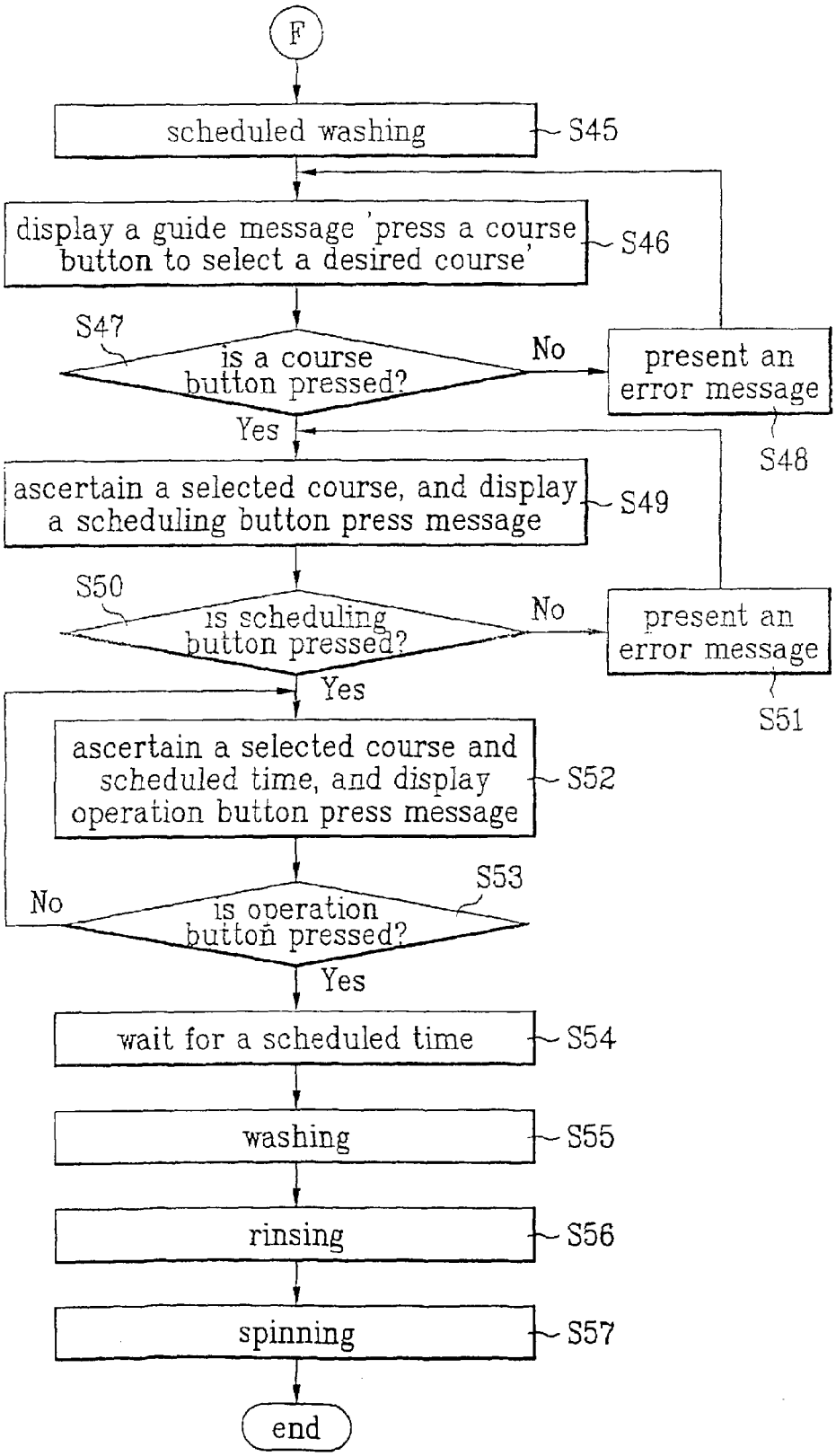
Figure 3H:
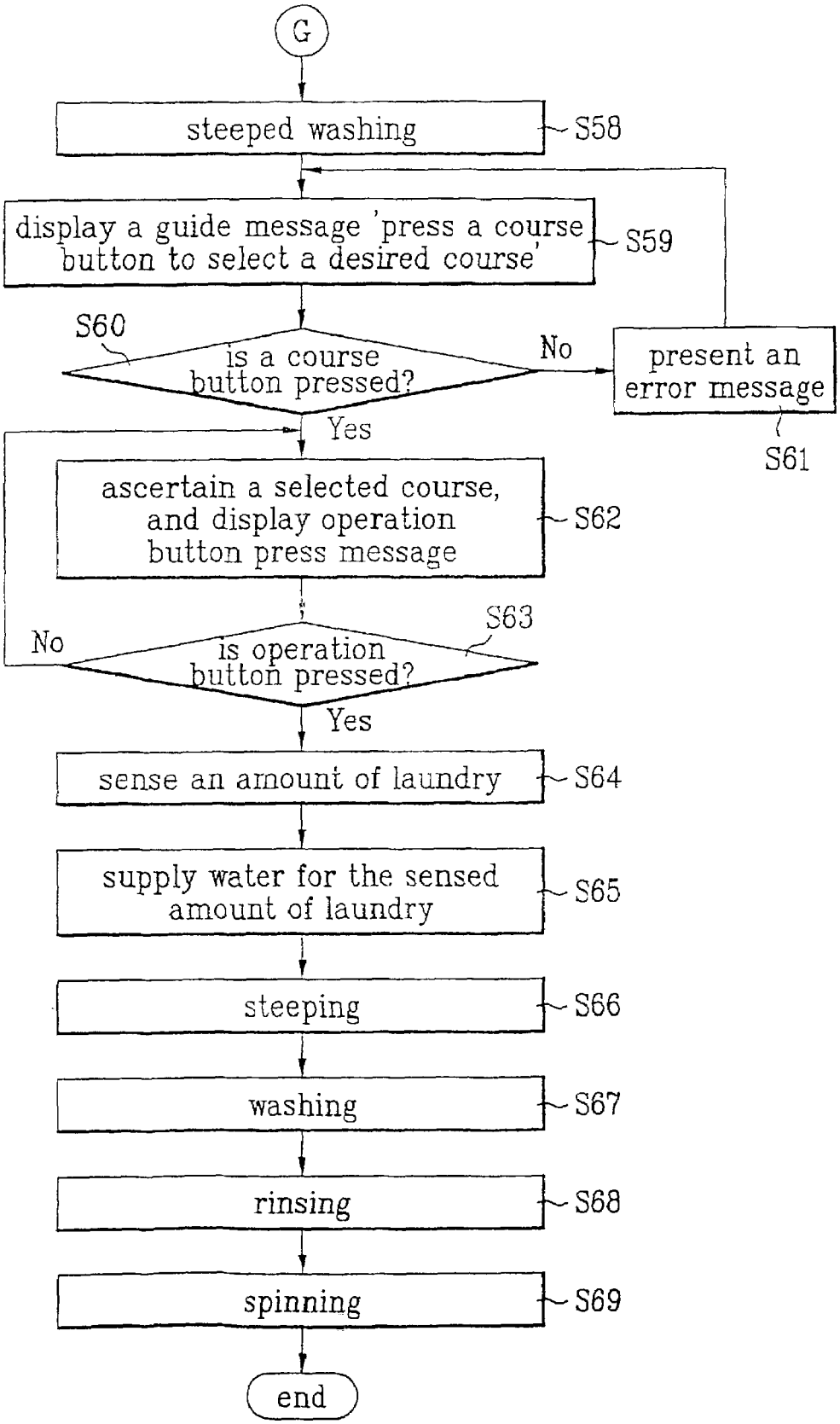
Figure 3I:
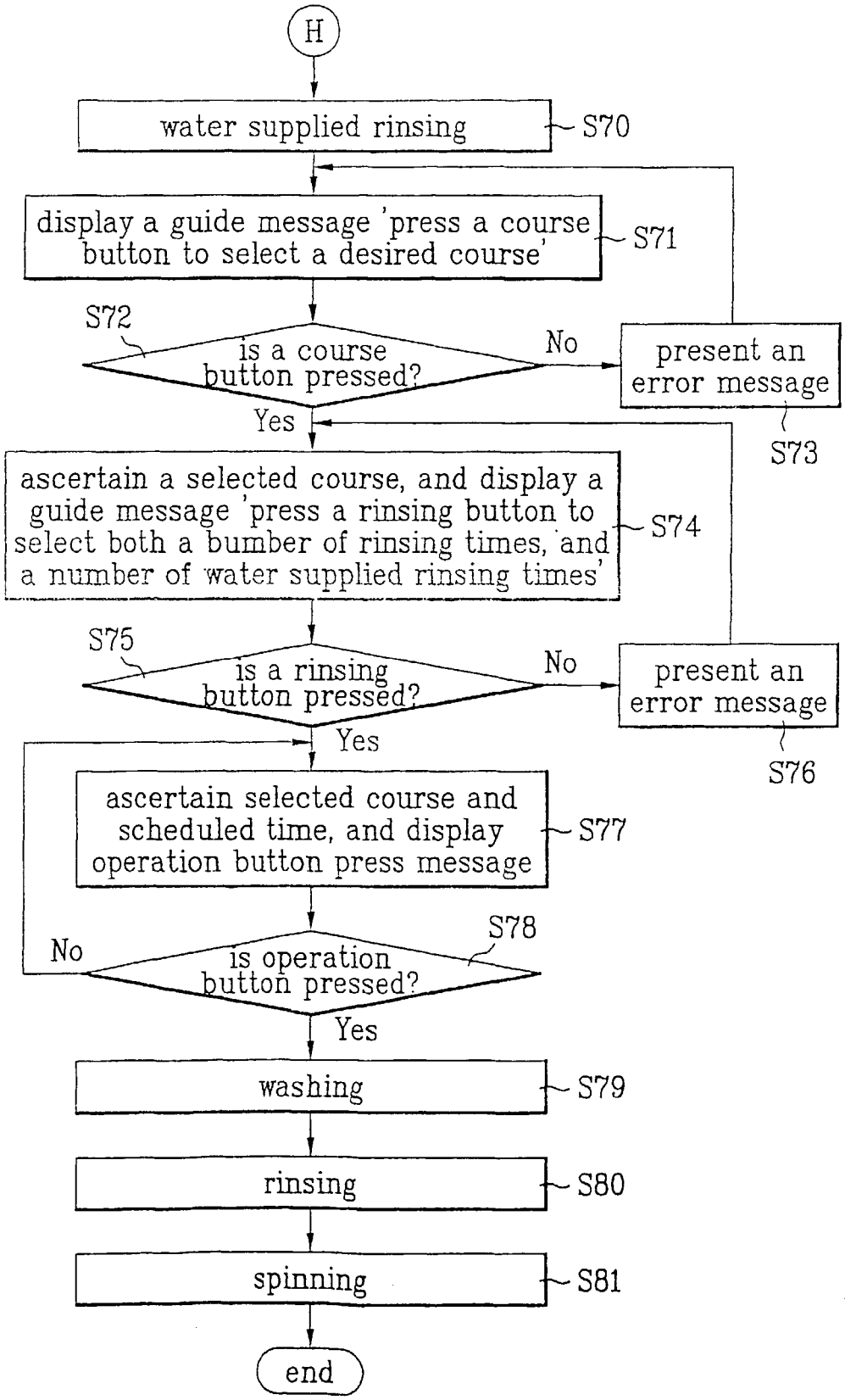
Figure 4:
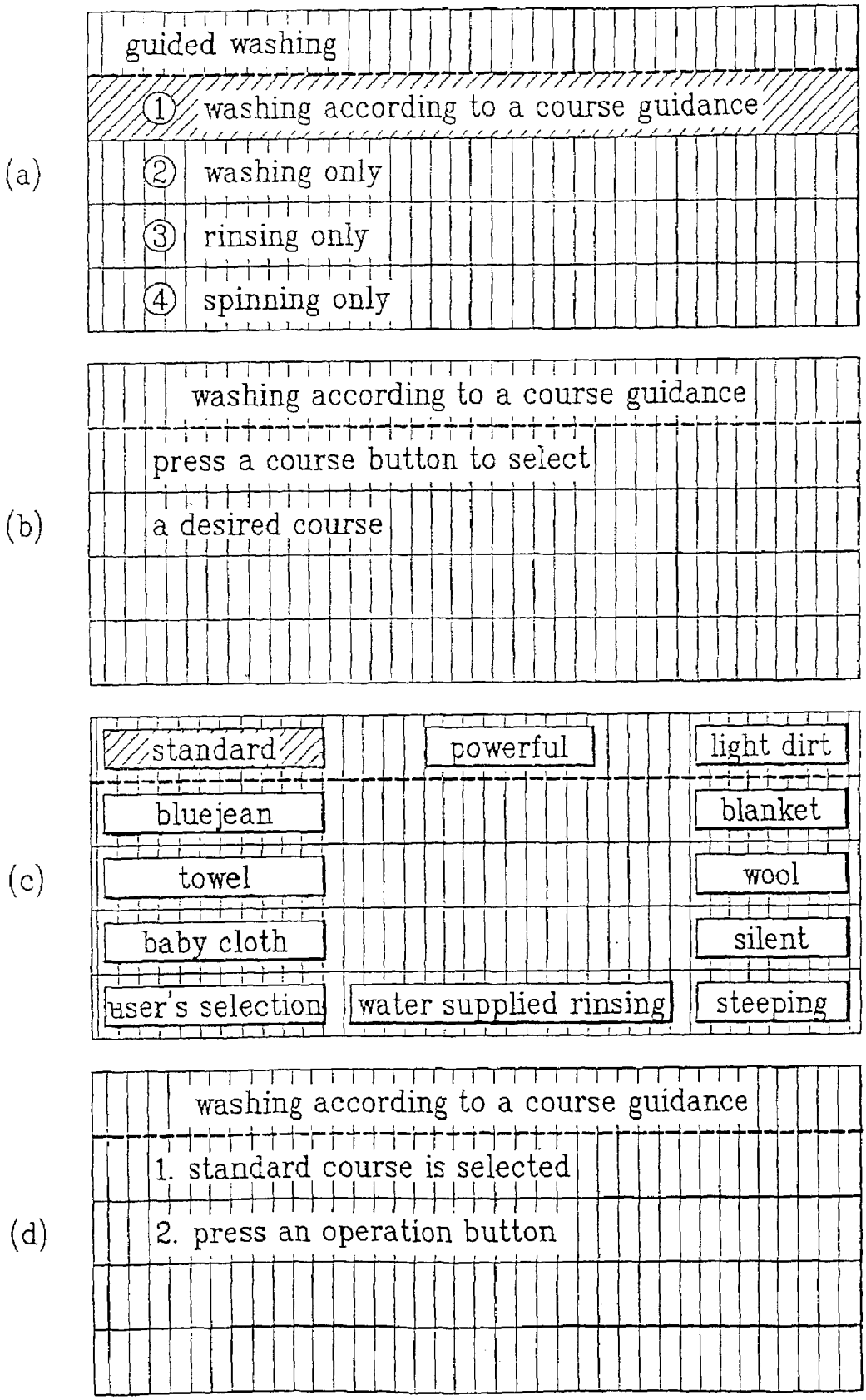
FIGS. 4–11 illustrate embodiments of the method for guiding use of a washing machine of the present invention.
Figure 5:
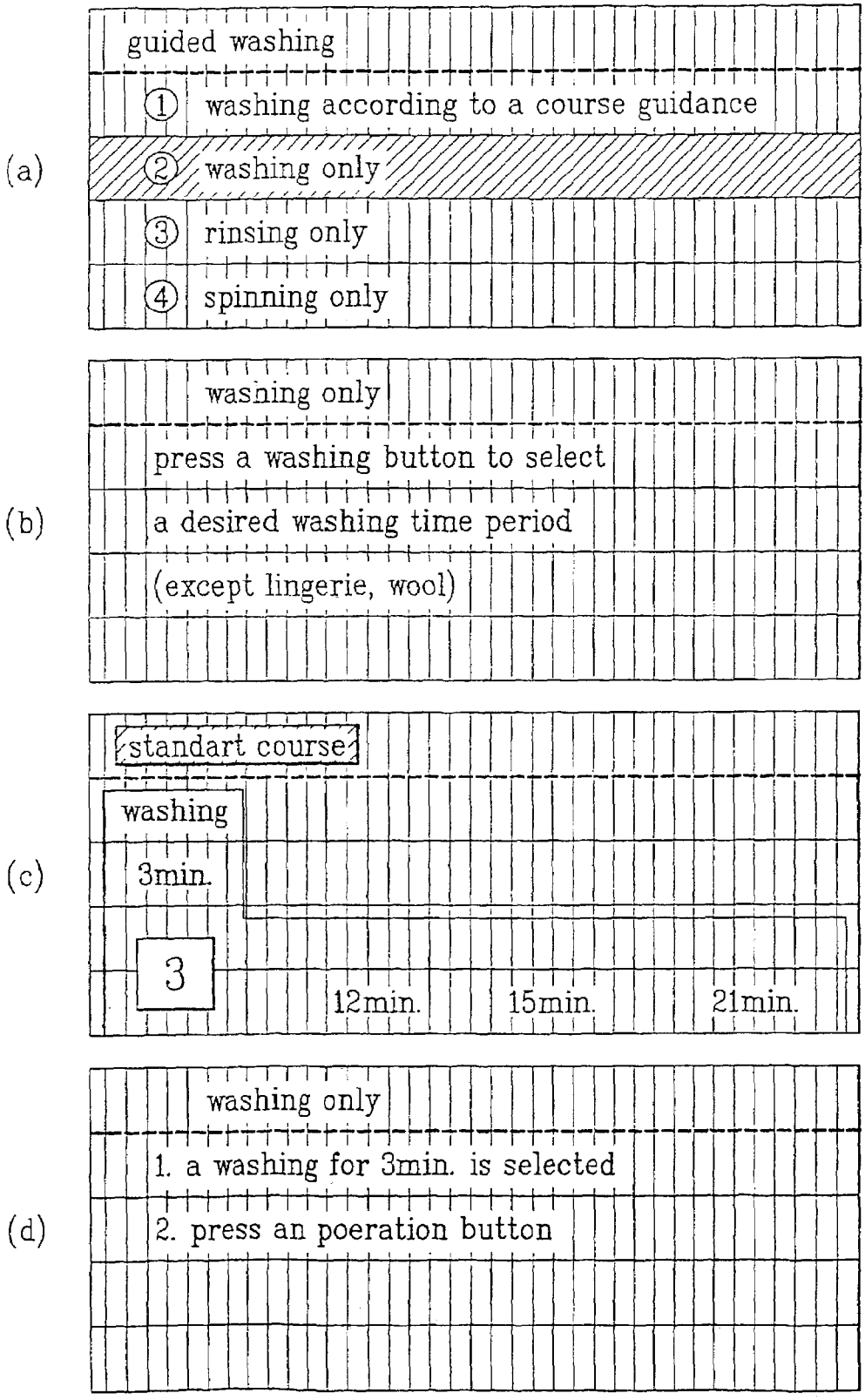
Figure 6:
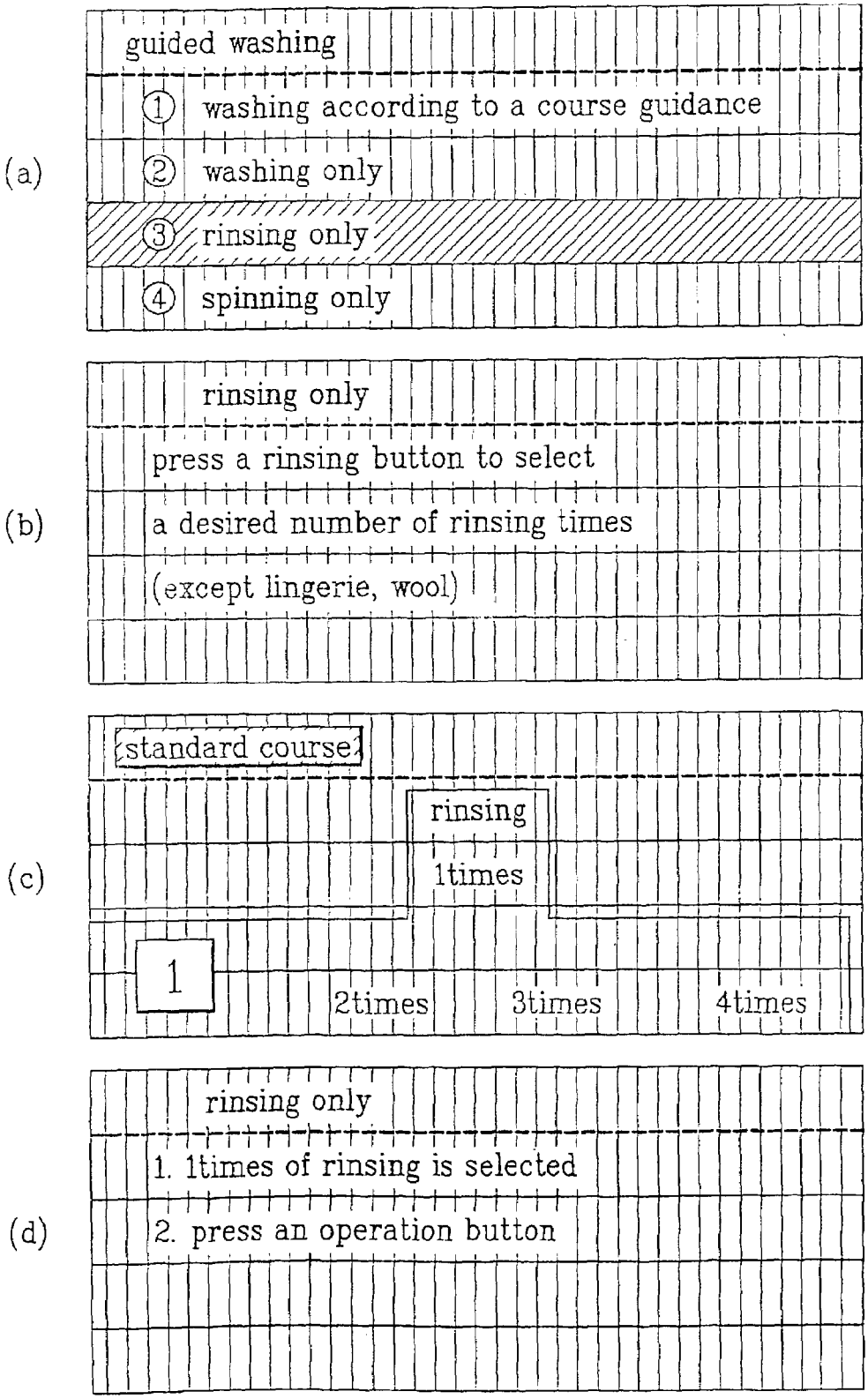
Figure 7:
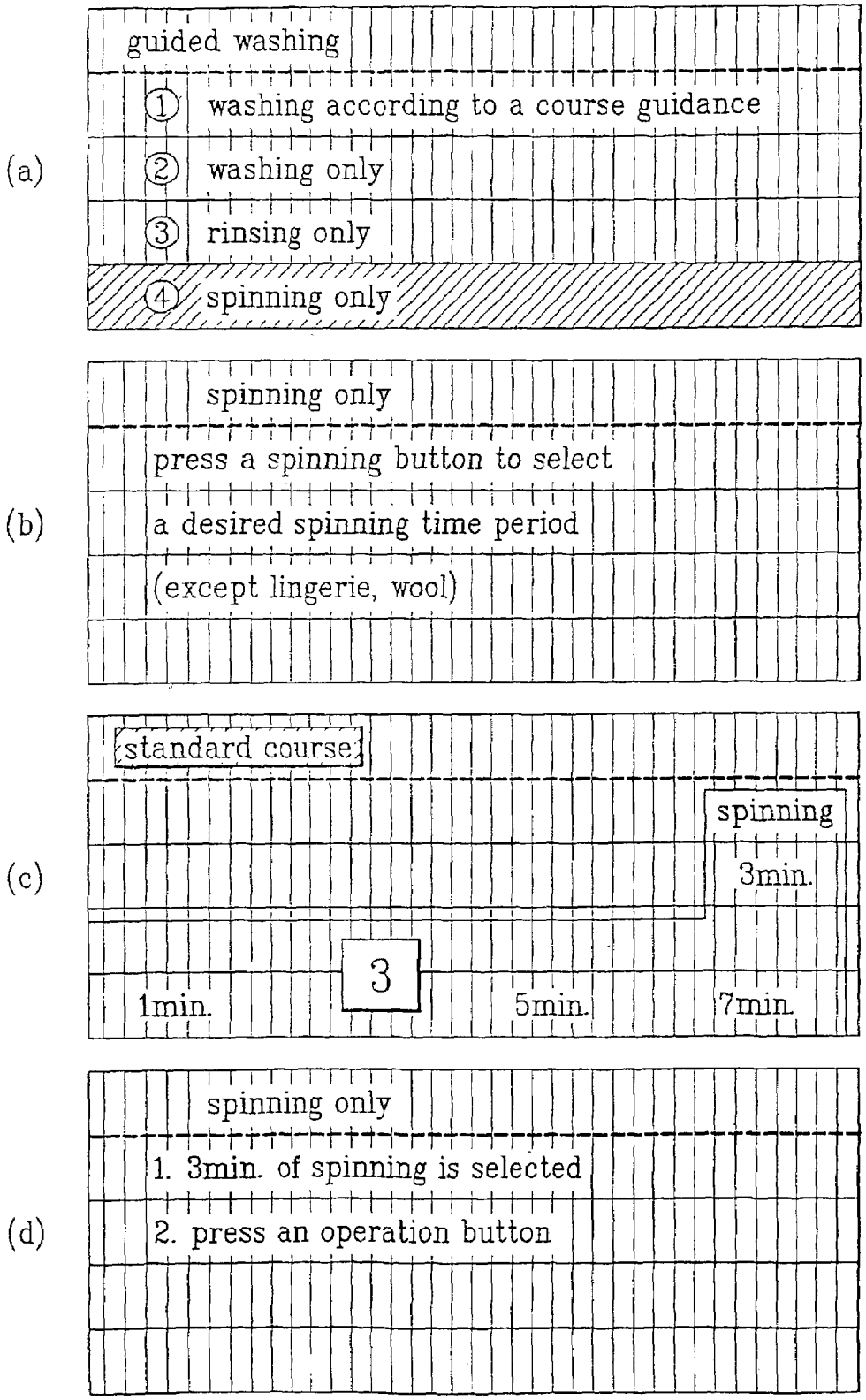
Figure 8:
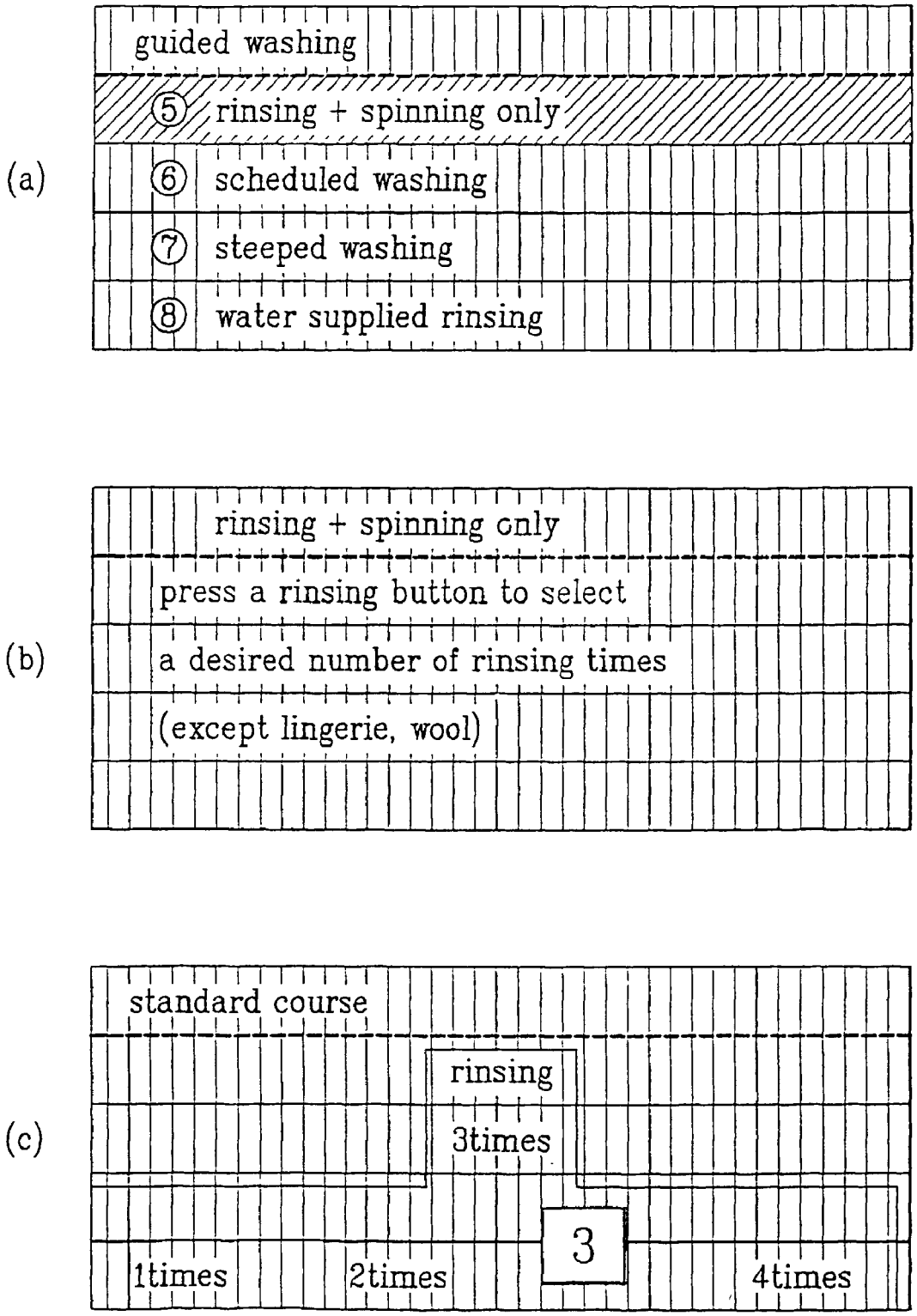
Figure 8:
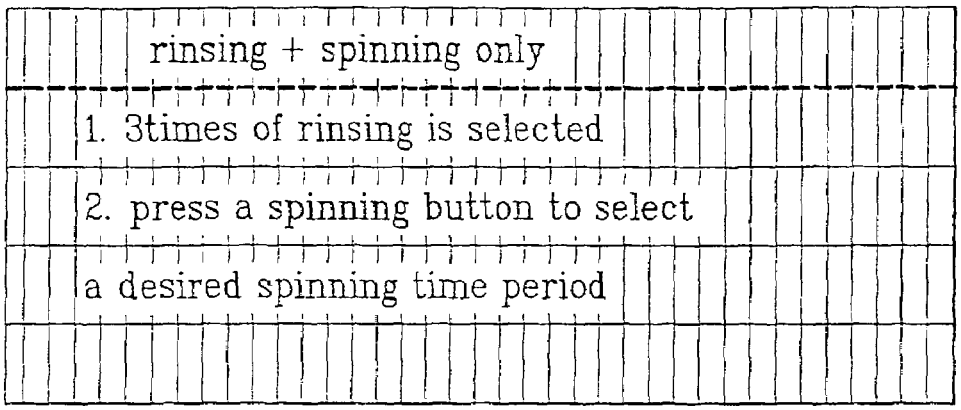
Figure 8:
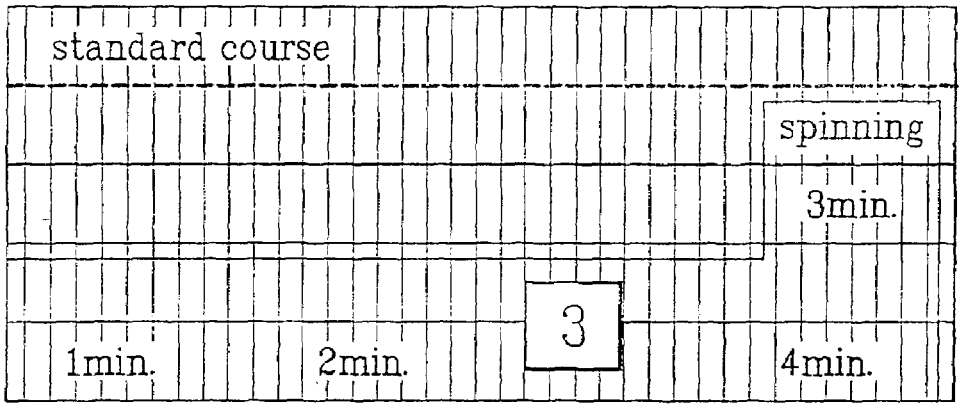
Figure 8:
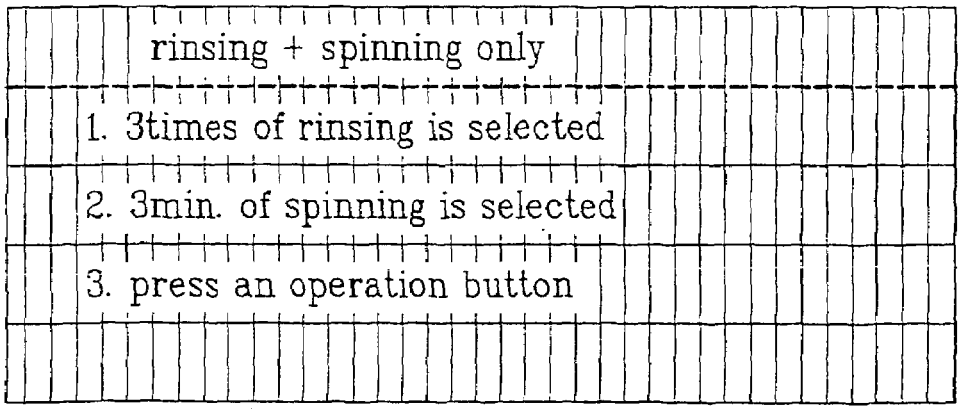
Figure 9:
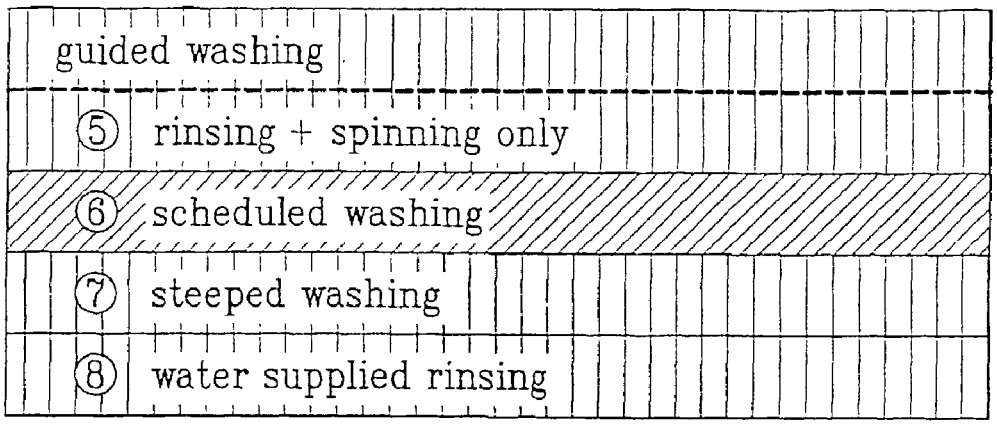
Figure 9:
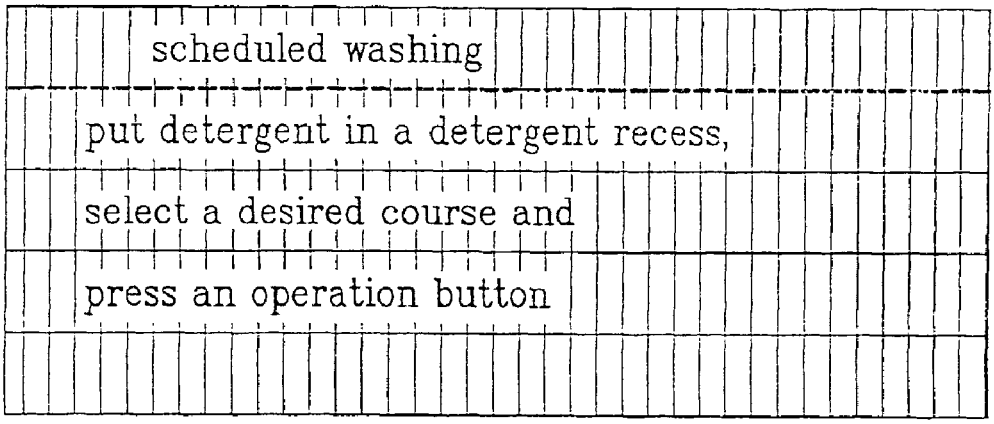
Figure 9:
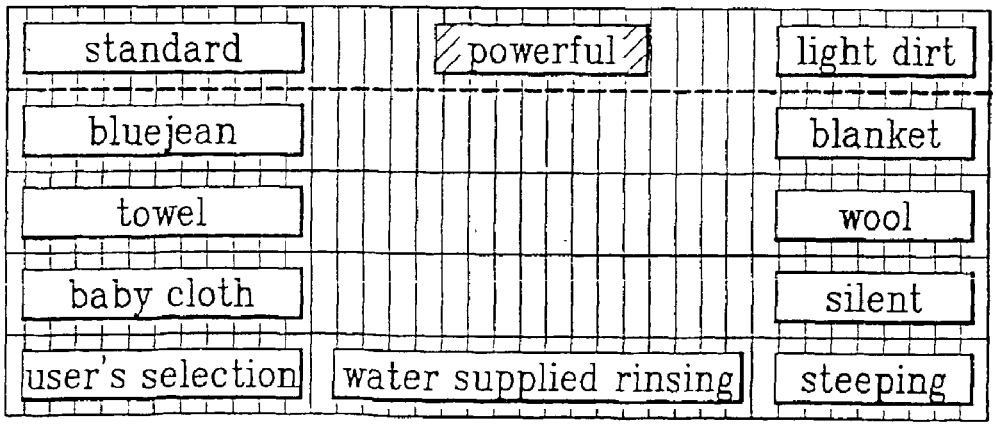
Figure 9:
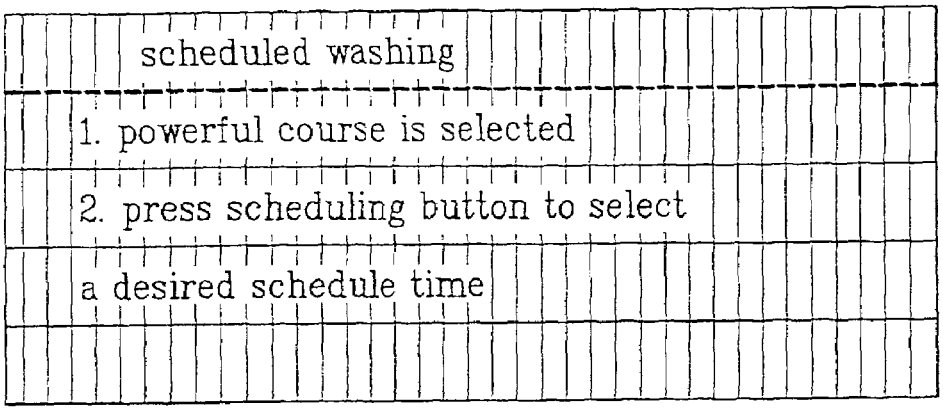
Figure 9:
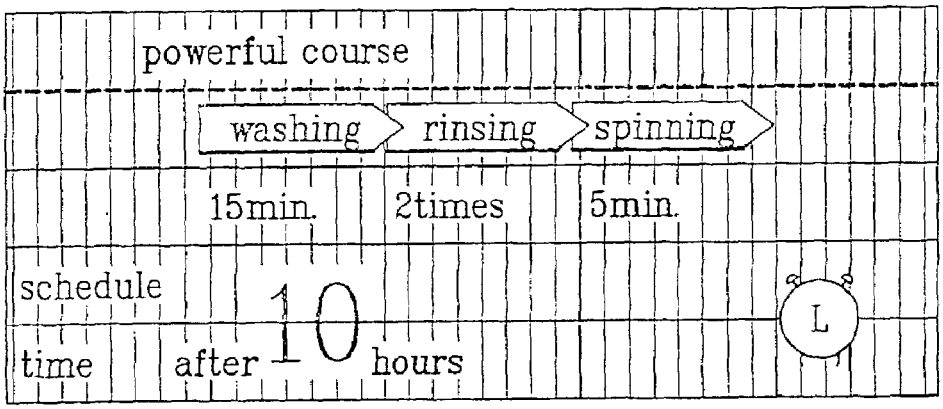
Figure 9:
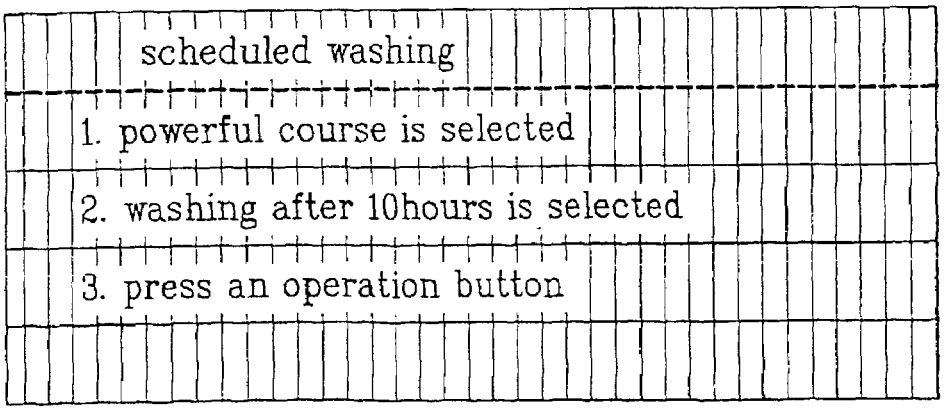
Figure 10:
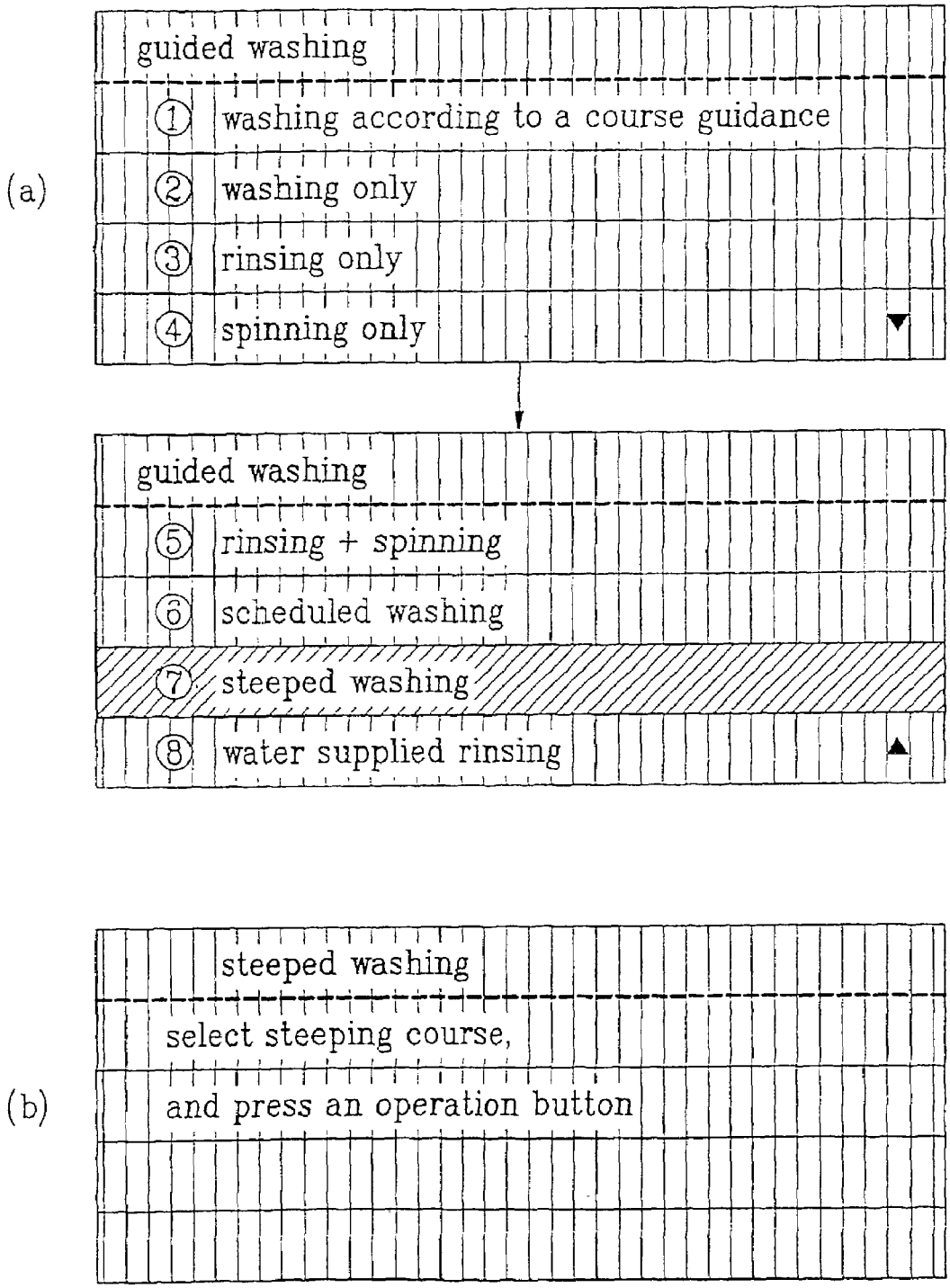
Figure 10:
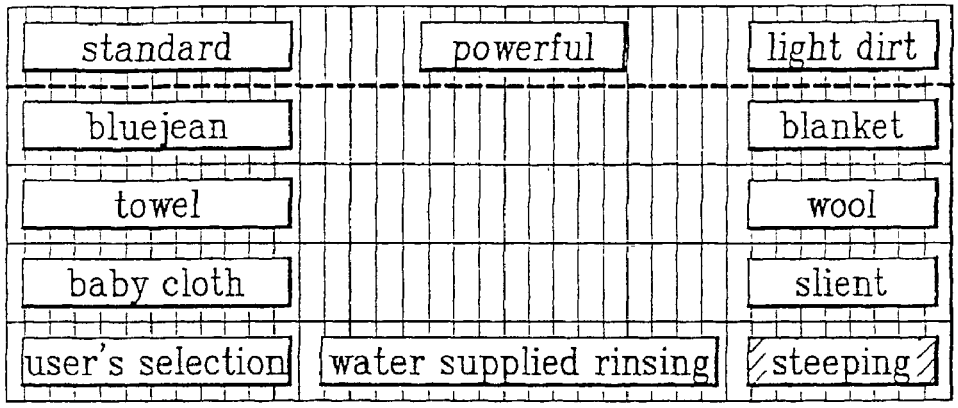
Figure 10:
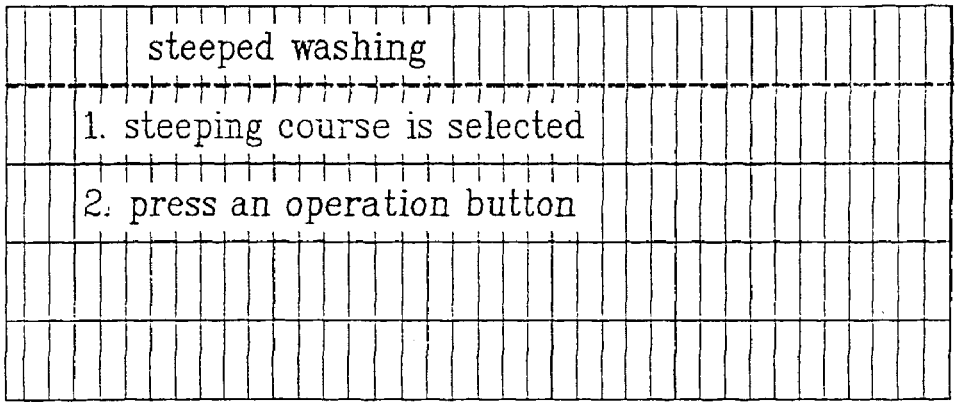
Figure 10:
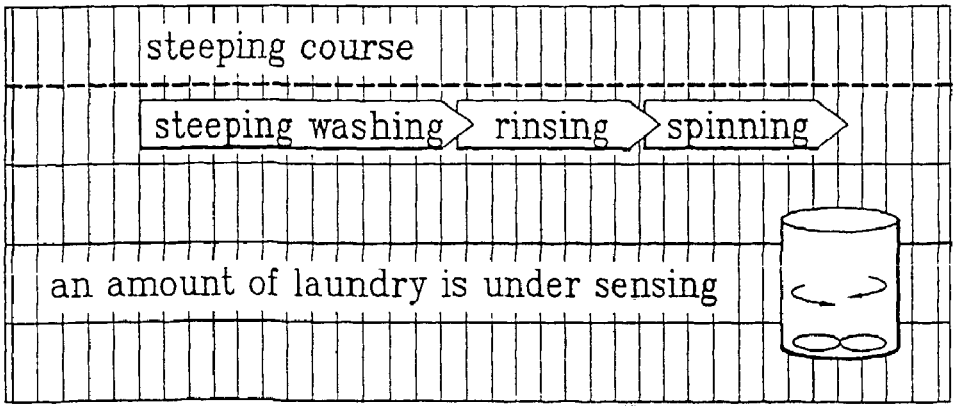
Figure 11:
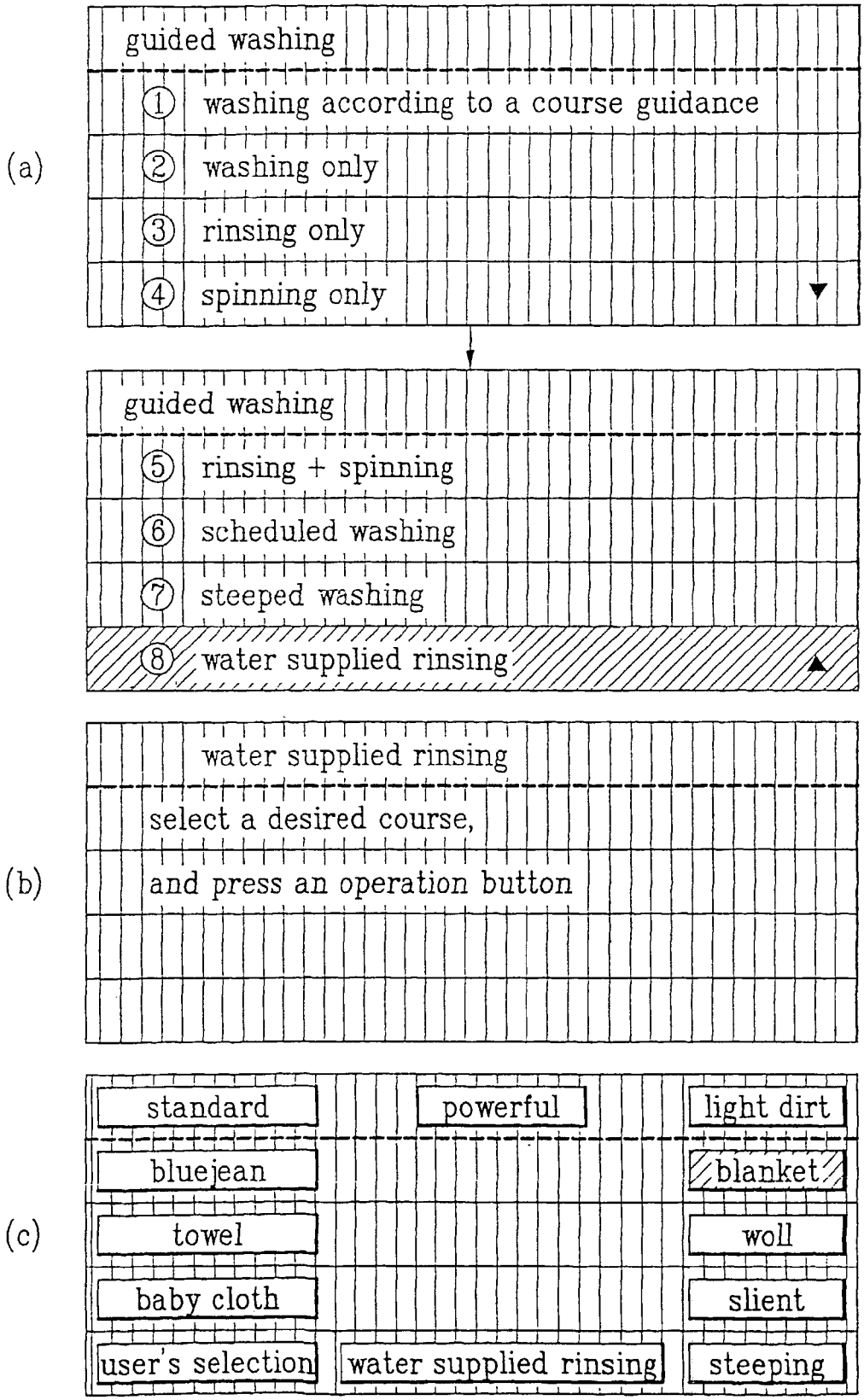
Figure 11:
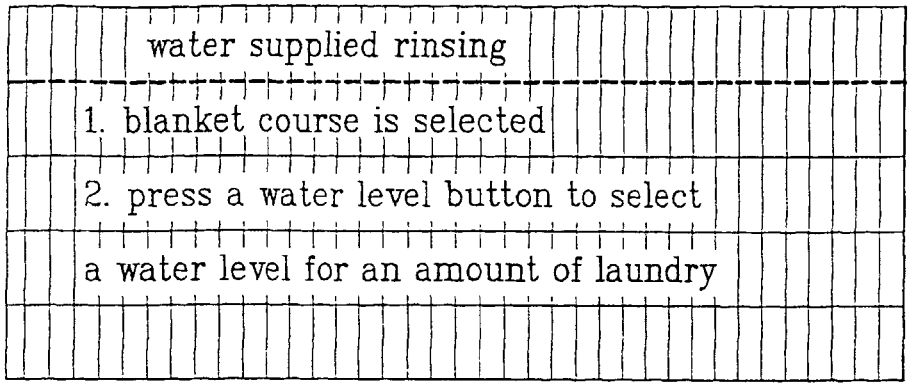
Figure 11:
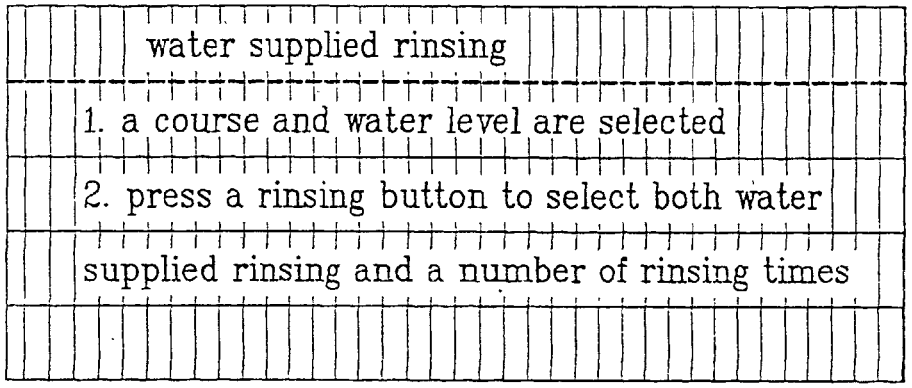
Figure 11:
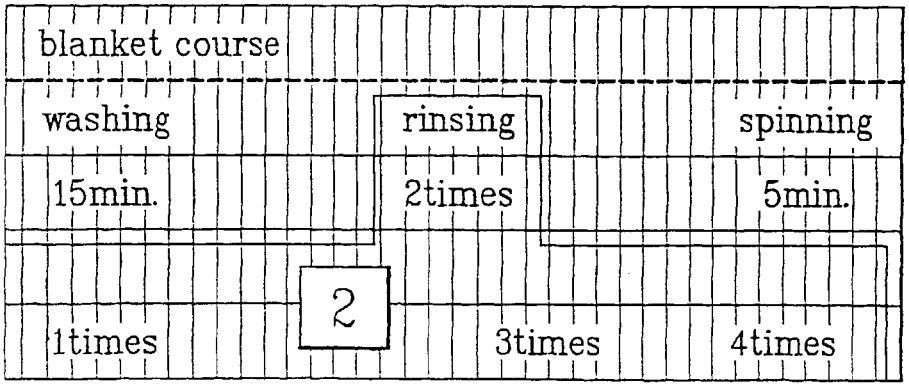
Figure 11:
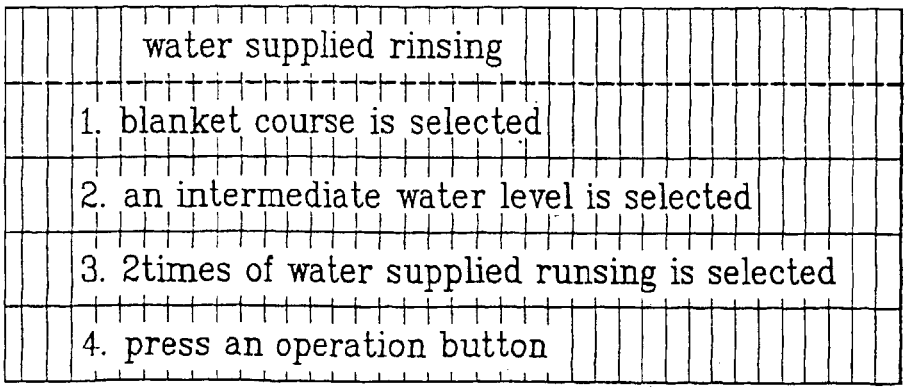

Reference will now be made in detail to the preferred embodiments of the present invention, embodiments of which are illustrated in the accompanying drawings. FIG. 2 illustrates a block diagram showing a system of a washing machine in accordance with a preferred embodiment of the present invention, and FIGS. 3A–3I illustrate flow charts each showing the steps of a method for guiding use of a washing machine in accordance with a preferred embodiment of the present invention.

Referring to FIG. 2, the washing machine in accordance with a preferred embodiment of the present invention includes an interface part 20 for carrying out data modulation so as to make data exchange with a PC 10 connected according to RS-232C communication standards, a key application part 30 for selecting a washing course, and a washing function, of user's preference, a storage part 40 for storage of washing guide information for washing courses, and washing guidance for respective courses, an LCD 90 for displaying the washing course, and the washing guide information selected at the key application part 30, a system microcomputer 50 for providing a control signal so that a load is driven according to the washing condition the user selects at the key application part 30 with reference to the washing guide information displayed on the LCD 90, a drive microcomputer 60 for controlling driving of the load according to the control signal from the microcomputer 50, and miscellaneous load driving parts 80 for driving various loads, such as the motor 70, the water supply valve (not shown), the drain valve (not shown), and the like, in accordance with a control signal from the drive microcomputer 60.

The steps of a method for guiding use of a washing machine in accordance with a preferred embodiment of the present invention will be explained with reference to FIGS. 3A–3I.

At first, a power to the washing machine is turned on (S1). Then, a guided washing is selected from menu displayed on the LCD 90 (S2), to display at least one washing cycle (S3). The washing cycles in the guide washing may be a washing according to a course guidance, a washing only, a rinsing only, a spinning only, a rinsing+spinning, a scheduled washing, a steeped washing, and a water supplied rinsing, and the like.

If the user selects 'the washing according to a course guidance' from the displayed washing cycles, a guide message of 'press a course button to select a desired course' is displayed (S4–S5). Then, user's press on the course button is determined (S6). As a result of the determination (S6), if the user does not press the course button, an error message is presented, and the washing process returns to the step 5 (S7). On the other hand, as the result of the determination (S6), if the user presses the course button, the selected course, and an operation button pressing message are displayed (S8). When the user presses the operation button, cycles are progressed in an order of washing→rinsing→spinning (S9–S12).

If the user selects 'the washing only' from the displayed washing cycles, a guide message of 'press a washing button to select a desired washing time period (except lingerie', wool)' is displayed (S13–S14). Then, user's press on the washing button is determined (S15). As a result of the determination (S15), if the user does not press the washing button, an error message is presented, and the washing process returns to the step 14 (S16). On the other hand, as the result of the determination (S15), if the user presses the washing button, the washing time period the user selects, and an operation button pressing message are displayed (S17). When the user presses the operation button, only the washing cycle is carried for the set time period (S18–S19).

If the user selects 'the rinsing only' from the displayed guided washing, a guide message of 'press a rinsing button to select a desired number of rinsing times (except lingerie', wool)' is displayed (S20–S21). Then, user's press on the rinsing button is determined (S22). As a result of the determination (S22), if the user does not press the rinsing button, an error message is presented, and the washing process returns to the step 21 (S23). If the user presses the rinsing button, the selected rinsing time period, and an operation button pressing message are displayed (S24). When the user presses the operation button, the rinsing cycle is carried for the number of rinsing times set by the user (S25–S26).

If the user selects 'the spinning only' from the washing cycles in the displayed guided washing menu, a guide message of 'press a desired spinning button to select a desired spinning time period (except lingerie', wool)' is displayed (S27–S28). Then, user's press on the spinning button is determined (S29). As a result of the determination (S24), if the user does not press the spinning button, an error message is presented, and the washing process returns to the step 28 (S30). On the other hand, as the result of the determination (S24), if the user presses the spinning button, the spinning cycle is carried for the spinning time period set by the user (S32–S33).

If the user selects 'the rinsing+spinning' from the washing cycles in the displayed guided washing menu, a guide message of 'press a rinsing button to select a desired number of rinsing times (except lingerie', wool)' is displayed (S34–S35). Then, user's press on the rinsing button is determined (S36). If the user does not press the rinsing button, an error message is presented, and the washing process returns to the step 35 (S37). On the other hand, if the user presses the rinsing button, both the selected number of rinsing times, and a guide message 'press a spinning button to select a desired spinning time period' are displayed (S38). Then, the user's press on the spinning button is determined (S39). As a result of the determination (S39), if the user does not press on the spinning button, an error message is presented, and the process returns to the step 39 (S40). As a result of the determination (S39), if the user presses the spinning button, the selected number of rinsing times, and spinning time period, and a message for pressing an operation button, are displayed (S41). If the user presses the operation button, the rinsing cycle is carried out for the set number of rinsing times, the spinning cycle is carried out for the set spinning time period, and process ends (S422–S44).

If the user selects 'the scheduled washing' from the washing cycles in the displayed guided washing menu, a guide message of 'put detergent in the detergent recess, and press a course button to select a desired course' is displayed (S45–S46). Then, user's press on the course button is determined (S47). As a result of the determination (S47), if the user presses the course button, the selected course, and 'press a scheduled washing button to select a desired washing time' is displayed (S49). Then, user's press on the desired washing time button is determined (S50). As a result of the determination (S50), if the user does not press the desired washing time button, an error message is presented, and the process returns to the step S49 (S51). On the other hand, as a result of the determination (S50), if the user presses the desired washing time button, the selected course, and operation button pressing message are displayed (S52). If the user presses the operation button, after waiting for the desired washing time, a washing cycle,→a rinsing cycle→a spinning cycle are carried out in succession (S53–S57).

If the user selects 'the steeped washing' from the washing cycles in the displayed guided washing menu, a guide message of 'press a course button to select a steep course' is displayed (S58–S59). Then, user's press on the course button is determined (S60). As a result of the determination (S60), if the user does not press the course button, an error message is presented, and the process returns to the step 59 (S61). On the other hand, as the result of the determination (S60), if the user presses the course button to select the steep course, a message that the steep course is selected, and the operation button pressing message are displayed (S62). When the user presses the operation button, an amount of laundry is sensed, and water is supplied as required for the laundry (S63–S65). Upon finishing the water supply, the steep cycle is carried out as much as the set time period, a washing cycle,→a rinsing cycle→a spinning cycle are carried out in succession (S66–S69).

If the user selects 'the water supplied washing' from the washing cycles in the displayed guided washing menu, a guide message of 'press a course button to select a desired course' is displayed (S70–S71). Then, user's press on the course button is determined (S72). As a result of the determination (S72), if the user does not press the rinsing button, an error message is presented, and the process returns to the step 71 (S73). On the other hand, as the result of the determination (S72), if the user presses the course button, the selected course is made sure, and a guide message 'press a rinsing button to select the water supplied rinsing, and a number of the rinsing' is displayed (74). The user's press of the rinsing button is determined (S75). As the result of the determination (S75), if the user does not press the rinsing button, an error message is presented, and the process returns to the step S74 (S76). Opposite to this, as the result of the determination (S75), if the user presses the rinsing button, a selected course, a water level, a water supplied rinsing, a number of rinsing times, and operation button pressing message are displayed (S77). Then, if the user presses the operation button, the washing cycle→the water supplied rinsing cycle→the spinning cycle are carried out according to the set conditions (S78–S81).

Embodiments of washing guidance for each washing cycle displayed on the LCD 90 according to the guided washing of the present invention will be explained with reference to FIGS. 4–11.

① Washing According to a Course Guidance

When a cursor is positioned at '① Washing according to a course guidance' as shown in FIG. 4A, and an 'enter' key is pressed, a guide message 'press a course button to select a desired course' as shown in FIG. 4B, and a course guide screen as shown in FIG. 4C are displayed. For an example, if the user presses the course button to select a standard course with reference to the FIG. 4C, a guide message '1. A standard course is selected. 2. Press an operation button.' is displayed as shown in FIG. 4D. Then, when the user presses the operation button, washing cycles are progressed according to the standard course.

② Washing Only

When the cursor is positioned at '② Washing only' as shown in FIG. 5A, and the 'enter' key is pressed, a guide message 'press a washing button to select a desired washing time period (except lingerie, and wool)' as shown in FIG. 5B, and a screen for selecting the washing time period as shown in FIG. 5C are displayed. For an example, if the user selects thee minutes with reference to the FIG. 5C, a guide message '1.3 min. washing is selected. 2. Press an operation button.' is displayed as shown in FIG. 5D. Then, when the user presses the operation button, washing cycles are progressed for three minutes.

③ Rinsing Only

When the cursor is positioned at '③ Rinsing only' as shown in FIG. 6A, and the 'enter' key is pressed, a guide message 'press a rinsing button to select a desired number of rinsing times (except lingerie, and wool)' as shown in FIG. 6B, and a screen for selecting the desired number of rinsing times as shown in FIG. 6C are displayed. For an example, if the user select one time of rinsing from a screen in FIG. 6C, a guide message '1. One time of rinsing is selected. 2. Press an operation button.' is displayed as shown in FIG. 6D. Then, when the user presses the operation button, the rinsing cycle set by the user is progressed for one time.

④ Spinning Only

When the cursor is positioned at '④ Spinning only' as shown in FIG. 7A, and the 'enter' key is pressed, a guide message 'press a spinning button to select a desired spinning time period (except lingerie, and wool)' as shown in FIG. 7B, and a menu for selecting the spinning time period as shown in FIG. 7C are displayed. For an example, if the user selects three minutes of spinning time period from the menu in FIG. 7C, a guide message '1. Three minutes of spinning time period is selected. 2. Press an operation button.' is displayed as shown in FIG. 7D. Then, when the user presses the operation button, the three minutes of spinning is carried out.

⑤ Rinsing+Spinning Only

When the cursor is positioned at '⑤ Rinsing+spinning only' as shown in FIG. 8A, and the 'enter' key is pressed, a guide message 'press a rinsing button to select a desired number of rinsing times (except lingerie, and wool)' as shown in FIG. 8B, and a menu for selecting the desired number of rinsing times as shown in FIG. 8C are displayed. For an example, if the user selects three times of rinsing from the menu in FIG. 8C, a guide message '1. Three times of rinsing is selected. 2. Press a spinning button to select a desired spinning time period.' is displayed as shown in FIG. 8D. If the user selects three minutes of spinning time period from the menu in FIG. 8E, a guide message '1. Three times of rinsing is selected. 2. Three minutes of spinning time period is selected. 3. Press an operation button.' is displayed as shown in FIG. 8F. Then, when the user presses the operation button, the three times of rinsing followed by three minutes of spinning is carried out.

⑥ Scheduled Washing

When the cursor is positioned at ⑥ Scheduled washing as shown in FIG. 9A, and the 'enter' key is pressed, a guide message 'put detergent in a detergent recess, and press a course button to select a desired course' as shown in FIG. 9B, and a menu for selecting a course as shown in FIG. 9C are displayed. For an example, if the user selects a powerful course from the menu in FIG. 9C, a guide message '1. The powerful course is selected. 2. Press a wash scheduling button to select a desired wash schedule', and a screen for selecting 'the desired wash schedule' is displayed as shown in FIG. 9E. Then, If the user selects after a ten hours from the menu in FIG. 9E, a guide message '1. The powerful course is selected.

2. The washing schedule is fixed to be after 10 hours from now. 3. Press an operation button.' is displayed as shown in FIG. 9F. Then, when the user presses the operation button, the powerful course is carried out after 10 hours from now.

⑦ Steeped Washing

Figure 1:
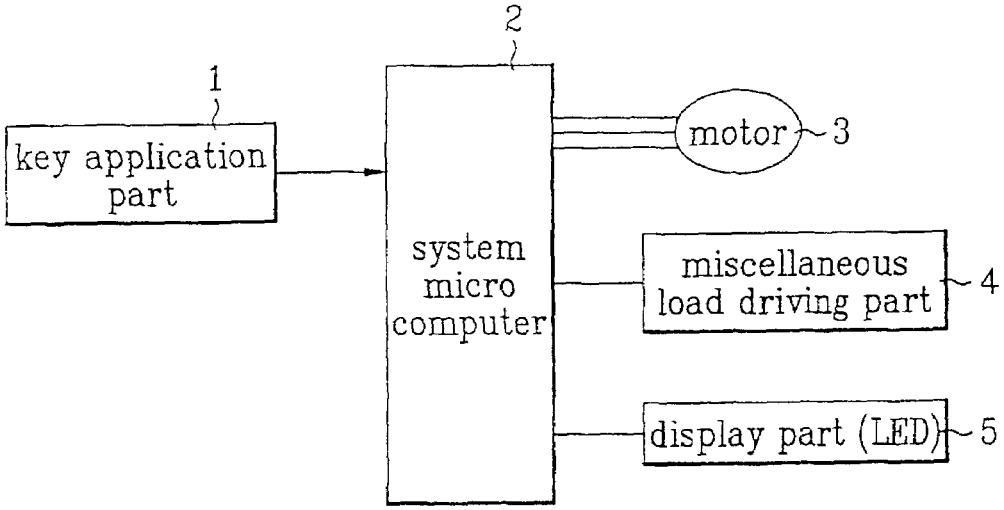
FIG. 1 illustrates a block diagram showing a system of a related art washing machine, schematically.

When the cursor is positioned at '⑦ Steeped washing' as shown in FIG. 10A, and the 'enter' key is pressed, a guide message 'press a course button to select a steeping course as shown in FIG. 10B, and a menu for selecting a course as shown in FIG. 10C are displayed. Then, if the user selects the steeping course from the menu in FIG. 1C, a guide message 1. The steeping course is selected. 2. Press an operation button.' is displayed as shown in FIG. 10D. Then, when the user presses the operation button, an amount of laundry is sensed, and water is supplied for the sensed amount of laundry. Then, after the steeping cycle is carried out as much as a set time period, the washing cycles are carried out.

⑧ Water Supplied Rinsing

When the cursor is positioned at '⑧ Water supplied rinsing' as shown in FIG. 11A, and the 'enter' key is pressed, after a guide message 'press a course button to select a desired course' as shown in FIG. 11B is displayed, a menu for selecting the desired course as shown in FIG. 11C is displayed. For an example, if the user selects a blanket course from the menu in FIG. 11C, a guide message '1. The blanket course is selected. 2. Press a water level button to select a desired water level for an amount of laundry.' is displayed as shown in FIG. 11D. For an example, if the user selects an intermediate water level, a guide message '1. The blanket course is selected. 2. The intermediate water level is selected., and 3. Press the rinsing button to select the water supplied rinsing, and a number of rinsing times.' is displayed as shown in FIG. 11F, and a menu for selecting water supply, and a number of rinsing times as shown in FIG. 11F is displayed. If the user selects two times of water supply, and two times of rinsing, with reference to FIG. 11F, a guide message '1. The blanket course is selected., 2. The intermediate water level is selected., two times of water supply, and rinsing are selected respectively., 4. Press an operation button.' is displayed. Then, when the user presses the operation button, the washing cycle→the water supplied rinsing→the spinning cycle are carried out in a succession after water is supplied to the intermediate course in the blanket course.

It will be apparent to those skilled in the art that various modifications and variations can be made in the washing machine, and method for guiding use of the washing machine of the present invention without departing from the spirit or scope of the invention. Thus, it is intended that the present invention cover the modifications and variations of this invention provided they come within the scope of the appended claims and their equivalents.

INDUSTRIAL APPLICABILITY

As has been explained, the washing machine, and method for guiding use of the washing machine of the present invention have the following advantages.

First, the guided washing provides conveniences to beginners as well as all users of the washing machine.

Second, the ascertaining of washing conditions set according to requirements of the user permits to an exact conduction of the washing cycles.

What is claimed is:

1. A method of using a washing machine having an LCD (liquid crystal display), comprising the steps of:

displaying a guided washing menu on the LCD, wherein the guided washing menu comprises a plurality of washing cycles;

receiving an input representing a desired washing cycle selected from the plurality of washing cycles displayed on the LCD;

displaying a guide message corresponding to the desired washing cycle; and displaying an error message if an input is not received in response to the displayed guide message, wherein the error message is displayed before the washing cycle begins; and wherein the plurality of washing cycles include a pre-selected washing cycle, a washing only cycle, a rinsing only cycle, or a spinning only cycle;

wherein the plurality of washing cycles further include a scheduled washing cycle, the scheduled washing cycle including the steps of:

displaying a guide message for selecting a washing course;

determining a desired washing course;

displaying the determined washing course, and a guide message for selecting a schedule time; and determining a desired schedule time.

2. A method as claimed in claim 1, wherein, if the washing cycle is the pre-selected washing cycle, the method further includes the steps of:

displaying at least one or more than one washing course according to clothes in the washing machine after a guide message for selecting a washing course is displayed, and determining a desired washing course from the displayed washing courses.

3. A method as claimed in claim 1, wherein, if the washing cycle is the washing only cycle, the method further includes the steps of:

displaying a guide message for selecting a washing time; and determining a desired washing time.

4. A method as clamed in claim 1, wherein, if the washing cycle is the rinsing only cycle, the method further includes the steps of:

displaying a guide message for selecting a number of rinsing times; and determining a desired number of rinsing times.

5. A method as claimed in claim 1, wherein, if the washing cycle is the spinning only cycle, the method further includes the steps of:

displaying a guide message for selecting a spinning time period; and determining a desired spinning time period.

6. A method as claimed in claim 1, wherein the plurality of washing cycles further includes a rinsing and spinning cycle including the steps of:

displaying a guide message for selecting a number of rinsing times;

determining a desired number of rinsing times;

displaying the determined number of rinsing times and a guide message requesting selection of a spinning time period; and determining a desired spinning time period.

7. A method as claimed in claim 1, wherein the plurality of washing cycles further includes a steeped washing cycle, the steeped washing cycle comprising the steps of:

displaying a guide message for selecting a steeping course; and determining a desired steeping course.

8. A method as claimed in claim 1, wherein the plurality of washing cycles further includes a water supplied washing cycle, the water supplied washing cycle comprising the steps of:

displaying a guide message for selecting a course;

determining a desired course;

displaying the determined course, and a guide message for selecting a water level;

displaying the determined course, the water level, and a guide message for selecting a number of water supplied rinsing times and a number of rinsing times; and displaying an operation button pressing message.

9. A method as claimed in claim 1, further including the step of displaying a determined washing condition.

10. A method as claimed in claim 9, further including the step of displaying a guide message for applying an operation message for conducting a next cycle according to determined conditions.

* * * * *